United States Patent [19]

Jones

[11] Patent Number: 4,646,592

[45] Date of Patent: Mar. 3, 1987

[54] POWER WRENCH

[76] Inventor: Massena F. Jones, Rte. 2, 650 Woodland Dr., Canton, Miss. 39046

[21] Appl. No.: 862,304

[22] Filed: May 12, 1986

[51] Int. Cl.[4] ..... B25B 21/02

[52] U.S. Cl. ..... 81/57.3

[58] Field of Search ..... 81/57.3, 57.38, 57.43, 81/57, 57.14

[56] References Cited

U.S. PATENT DOCUMENTS 3,564,953 2/1971 Able ..... 81/57.3

*Primary Examiner*—Frederick R. Schmidt

*Assistant Examiner*—Maurina Rachuba

*Attorney, Agent, or Firm*—Harvey B. Jacobson

[57] ABSTRACT

A power wrench utilizing a power transfer mechanism supported in a housing, on a frame or the like by which input rotational torque can be transferred to output rotational torque having different rotational speed and torque characteristics without exerting any reaction force against the housing or frame thereby eliminating the necessity of providing an external anchoring device for the housing or frame with the device having particular utility as a wrench for rotating nuts, bolts and the like but also being capable of effective use for various power transferring functions.

6 Claims, 4 Drawing Figures

POWER WRENCH

BACKGROUND OF THE INVENTION

1. Field of the Invention

The present invention generally relates to a power wrench utilizing a power transfer mechanism supported in a housing, on a frame or the like by which input rotational torque can be transferred to output rotational torque having different rotational speed and torque characteristics without exerting any reaction force against the housing or frame thereby eliminating the necessity of providing an external anchoring device for the housing or frame with the device having particular utility as a wrench for rotating nuts, bolts and the like but also being capable of effective use for various power transferring functions.

2. Information Disclosure Statement

Many types of power transfer devices have been developed which include the capability of varying the characteristics of the output of power in relation to the input of power. Included in such developments are power wrenches such as impact wrenches which are utilized to tighten and loosen nuts and bolts such as nuts used to retain vehicle wheels in place which, in some instances, tend to crystallize and thus weaken the material of the nuts and bolts. Also, various types of wrench handles have been provided in order to increase the lever arm through which power is applied to a nut or bolt to enable desired torque to be applied to the nut or bolt. Power wrenches may be driven manually, electrically, hydraulically or pnematically and usually includes a reduction gear assembly to provide desired output rotational speed and torque. However, such power wrenches usually include or require an external anchor or require that the operator of the wrench supply sufficient force to the handle to prevent rotation of the power wrench in a direction opposite to the direction of application of force by the output of the wrench.

SUMMARY OF THE INVENTION

An object of the present invention is to provide a power wrench incorporating a unique power transfer device or assembly that has special utility when incorporated into a power wrench, into other power tools and in other power transferring arrangements in which rotational characteristics of a power input and a power output are altered without imparting reverse rotational forces to a supporting structure for the components of the power transfer assembly.

Another object of the present invention is to provide a power wrench having an input drive gear connectible with a power source such as but not limited to a ratchet wrench output drive member combined with a driven gear in meshing engagement with the drive gear with the axes of rotation of the gears being maintained by a connecting bar or link. A shaft or bolt is connected to the driven gear in eccentric relation to the rotational axis thereof and provides support for an output disc, sprocket gear or the like that has a flexible belt or chain encircling a major portion of the perimeter of the disc or sprocket gears with the output disc or sprocket gear being eccentric with respect to the axis of the driven gear. An actuator bar extends radially from the axis of rotation of the drive gear with the ends of the belt or chain associated with opposite ends of the actuator with the end of the actuator bar coinciding with the axis rotation of the drive gear having a power output connected therewith.

A further object of the invention is to provide a power wrench in accordance with the preceding objects which is completely mechanical in nature, capable of providing various output power characteristics as compared to input power characteristics and which is quite simple in construction, relatively inexpensive to manufacture, easy to operate and maintain and efficient in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figures 3, 4:
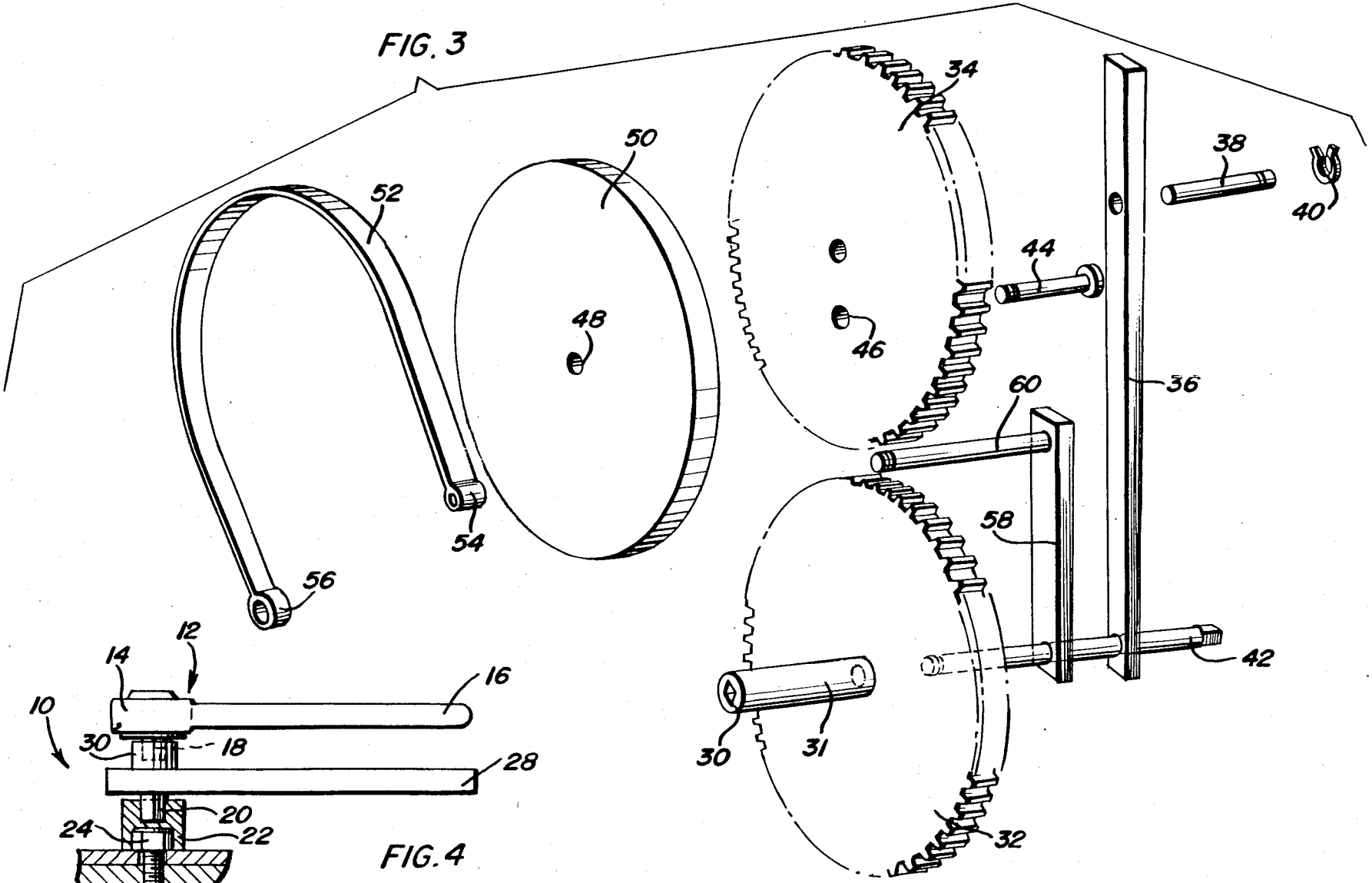
FIG. 3 is an exploded group perspective view of the components of the device.
FIG. 4 is an elevational view illustrating a mode of use of the invention.

Referring now specifically to the drawings, the power wrench is generally designated by numeral 10 in FIG. 4 and is illustrated in one use in association with a ratchet wrench 12 having the usual ratchet head 14, handle 16 and output drive 18. The power wrench 10 includes an output drive 20 comparable to the output drive 18 of the ratchet wrench on which is mounted a socket 22 for engagement with a nut 24 mounted on a bolt 26 in a conventional manner. The power wrench 10 includes a housing 28 of substantially any shape or configuration depending upon the size requirements for various uses with the power wrench also including an input adapter 30 that is engaged with the output drive 18 of the ratchet wrench 12 in a conventional manner with the rotational axes of the input adapter 30 and the output drive 20 of the power wrench being coincident so that, in effect, the power wrench 10 is disposed between the ratchet wrench output drive 18 and the socket 22 and nut 24 with which it is engaged in order to impart tightening or loosening torque to the nut 24 without providing any external anchor to the power wrench 10 thereby eliminating the necessity of providing an external anchor structure for the housing 28.

Figure 2:
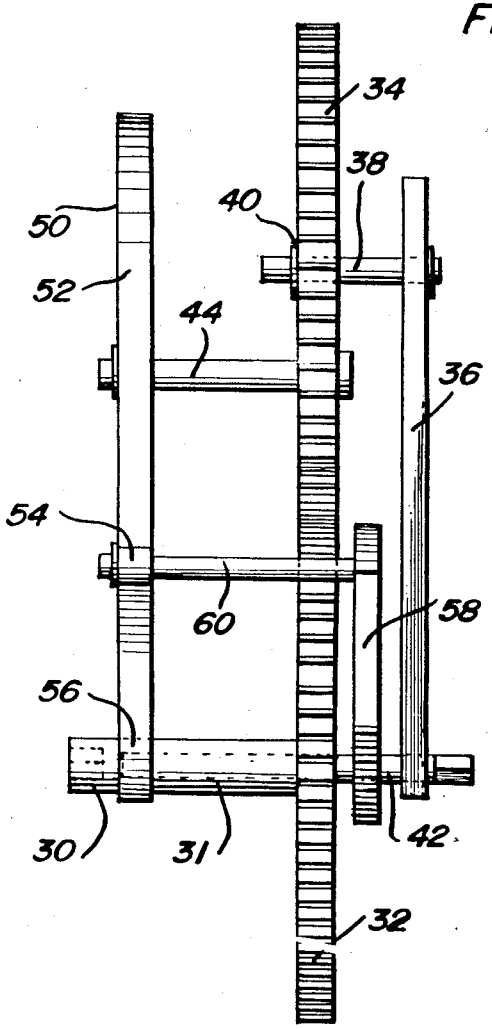
FIG. 2 is an elevational view of the assembly of FIG. 1.
Figure 1:
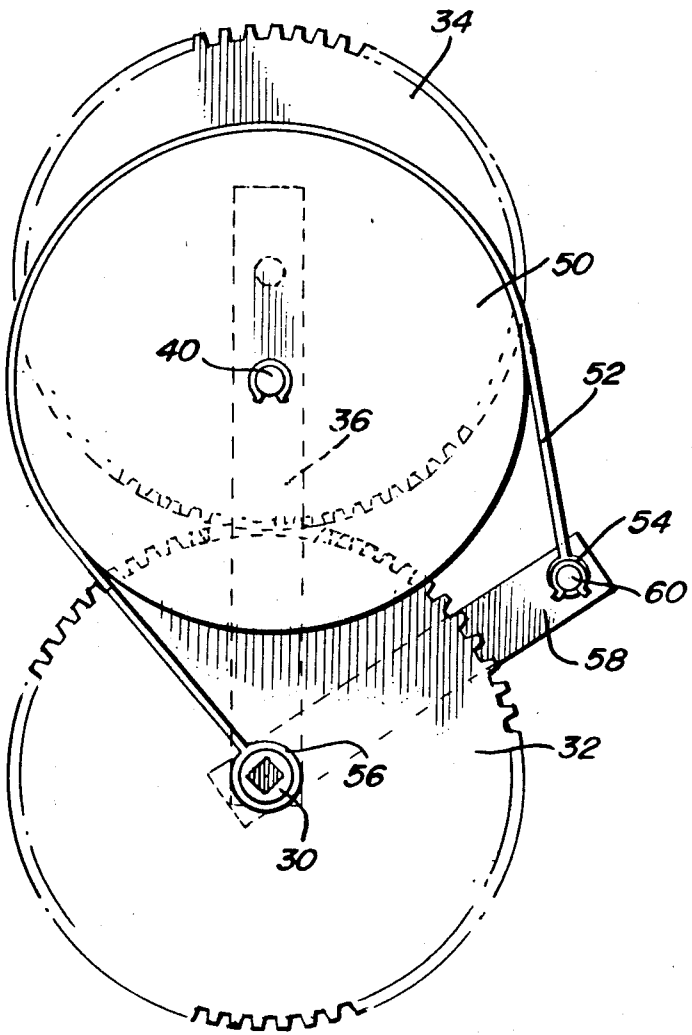
FIG. 1 is an end view of the power transfer assembly illustrating schematically the arrangement of the components.

The power wrench 10 includes a drive gear 32 having the input adapter 30 rigidly affixed thereto through a tube or sleeve 31 for driving the drive gear 32 directly from the ratchet 12. In meshing engagement with the drive gear 32 is a driven gear 34 which is in alignment with and in meshing engagement with the drive gear 32 with a connecting bar or link 36 retaining the gears 32 and 34 in properly spaced relation to each other with the end of the connecting bar 36 having a shaft or rod 38 at one end journalling the gear 34 at its center with retaining devices such as snap rings 40 securing these components together. The drive gear 32 and tube 31 are also rotatably supported on a shaft or post 42 having the output drive 20 rigid with the end thereof outwardly of connecting bar 36 with the other end of the connecting bar 36 also being journalled on shaft or rod 42 in order to maintain a constant relationship of the gears 32 and 34. The driven gear 34 includes a bolt, rod or shaft 44 supported through an eccentric hole 46 in driven gear 34 as illustrated in FIGS. 2 and 3 with the bolt 44 extending through a central aperture 48 in a disc 50 which receives a band or belt 52 around a major portion of its periphery. The band or belt 52 is preferably constructed of a metal strap having loops or eyes 54 and 56 on the respective ends thereof. One of the loops 56 is journalled on the end of the tube or sleeve 31 adjacent input adapter 30. The shaft 42 extends into the female input adapter 30 and has a snap ring or similar fastener securing the end of shaft 42 in the inner end of adapter 30 for relative rotation but preventing axial movement. An actuator or draw arm 58 has one end rigidly affixed to shaft 42 between drive gear 32 and connecting bar 36 for driving output drive 20. The other end of the bar 58 has a rod 60 extending parallel to the axis of the shaft 42 and is connected to the other loop or eye 54. While the structure disclosed includes a disc 50 and band 52, the disc 50 could be a sprocket gear and the band 52 a sprocket chain. Varience in the ratio of the input drive to the output drive is obtained by varying the eccentricity of the bolt or rod 44 in relation to the rotational axis of the driven gear 34 and the diameter of the disc 50.

When the drive gear 32 is rotated on the shaft 42 by connecting the ratchet wrench output drive 18 to the input adapter 30, which is rigid with sleeve 31 and gear 32, the driven gear 34 will be activated in response to rotation of the drive gear 32. This will rotate disc 50 that is attached to driven gear 34 by the offset post or bolt 44. This forces the disc 50 into the band 52 which has one end rotatably connected to the sleeve 31 and thus to the rod or shaft 42 for stabilization and the other end of the band 52 is attached to the post 60 on the actuator 58 thereby moving actuator 58 which in turn rotates shaft 42 having the square output drive 20 remote from but in alignment with the input adapter 30 for rotating the nut 24, bolt, stud or other device through a reduction ratio. Thus, the rotational axis of the input and output are coincidental with the movement of the actuator or draw arm 58 providing rotational torque through the output drive 20 to the socket 22 which is detachably connected thereto so that any size socket may be employed. While snap rings are shown securing the various components together, the fastening and retaining devices may vary depending upon the size requirements of various uses for the invention. The device is self-contained and does not include any external anchoring device and does not impart impact forces to the nut or bolt being tightened or loosened. The disc 50 which is eccentrically mounted in relation to the driven gear 34 acts as an eccentric cam which turns the actuator or draw arm 58 which may be in the form illustrated or may be in the form of a circular member or other shape. The reduction in rotational output speed and increase in torque is determined by the eccentric relationship of the centers of the disc 50 and driven gear 34.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A power wrench comprising a drive gear, means supporting said drive gear for rotation about a central axis, means connected to the drive gear for rotatably driving the drive gear, a driven gear in meshing engagement with the drive gear, means rotatably supporting the driven gear with the axis of rotation in spaced parallel relation to the axis of rotation of the drive gear for maintaining the driven gear in meshing engagement with the drive gear during relative movement therebetween, cam means eccentrically mounted on said driven gear, a band partially encompassing the periphery of the cam means, an actuator arm being supported for movement about the axis of the drive gear at one end, one end of the band connected to the means for rotatably driving the drive gear, and the other end of the band connected to the other end of the actuator whereby movement of the cam means causes movement of the band and actuator arm providing output torque to the output drive on the actuator.

2. The structure as defined in claim 1 wherein said means connected to the drive gear for rotating same includes an adapter rigid with the drive gear and including a polygonal socket for receiving the output drive of a ratchet wrench.

3. The structure as defined in claim 2 wherein the output drive on the actuator includes a polygonal projection adapted to receive a socket for engagement with a nut, bolt or the like.

4. The structure as defined in claim 3 wherein said means supporting the driven gear includes a connector bar having one end rotatably supported from the support means for the drive gear and the other end rotatably supporting the driven gear to maintain the parallel spaced relation between the axes of rotation during rotational and orbiting movement of the driven gear.

5. The structure as defined in claim 4 wherein said cam means is in the form of a circular disc and means supporting the center of the cirular disc from the driven gear in radially spaced relation to the rotational axis of the driven gear.

6. The structure as defined in claim 5 wherein said actuator arm includes a rod at said other end spaced outwardly from the periphery of the circular disc and connected to the band with one end of the actuator being pivotal about an axis coincident with the axis of rotation of the drive gear and the other end being spaced radially from the rotational axis to provide a lever arm for rotating the output drive rigid with the actuator arm for imparting rotational torque to a socket mounted on the output drive.

* * * * *